US005749676A

United States Patent [19]

Head

[11] Patent Number: 5,749,676

[45] Date of Patent: May 12, 1998

[54] METHOD OF ACCESSING A SUB SEA WELL AND A GUIDE ARRANGEMENT THEREFOR

[76] Inventor: Philip Head, 6 Leith Mansions, Grantully Road, London W9 1LQ, Great Britain

[21] Appl. No.: 588,196

[22] Filed: Jan. 18, 1996

[30] Foreign Application Priority Data

Jan. 18, 1995 [GB] United Kingdom ..... 950 09 54.4

[51] Int. Cl.[6] ..... E21B 33/043; E21B 33/072; E21B 41/04; F16L 11/133

[52] U.S. Cl. ..... 405/171; 166/345; 166/360; 405/195.1

[58] Field of Search ..... 405/169, 170, 405/171, 195.1; 166/345, 360, 367

[56] References Cited

U.S. PATENT DOCUMENTS

| | | | |
|---|---|---|---|
| 3,503,219 | 3/1970 | Houot | 405/169 |
| 4,040,264 | 8/1977 | Neilon | 405/224.2 |
| 4,109,478 | 8/1978 | Gracia | 405/169 X |
| 4,176,986 | 12/1979 | Taft et al. | 405/211 |
| 4,182,584 | 1/1980 | Panicker et al. | 405/224.3 |
| 4,234,047 | 11/1980 | Mott | 175/5 |
| 5,069,580 | 12/1991 | Herwig et al. | 405/191 |
| 5,159,982 | 11/1992 | Hynes | 166/345 |
| 5,255,743 | 10/1993 | Adam et al. | 166/345 |
| 5,381,865 | 1/1995 | Blandford | 166/344 |

FOREIGN PATENT DOCUMENTS

| | | |
|---|---|---|
| 1 455 958 | 11/1976 | United Kingdom . |
| 1 519 203 | 7/1978 | United Kingdom . |
| 2 058 887 | 4/1981 | United Kingdom . |

*Primary Examiner*—Tamara L. Graysay
*Assistant Examiner*—Tara L. Mayo
*Attorney, Agent, or Firm*—Herbert Dubno

[57] ABSTRACT

A system for accessing a subsea well in which a guide on a buoy system is tethered to the well head and the buoy is evacuated to render the guide arrangement rigid and a flexible coil tubing from a surface vessel above the well head is guided through this arrangement to the well head while adjustable buoyancy is provided along the flexible tubing between the vessel and the well head for controlling the profile of the tubing.

11 Claims, 10 Drawing Sheets

METHOD OF ACCESSING A SUB SEA WELL AND A GUIDE ARRANGEMENT THEREFOR

FIELD OF THE INVENTION

This invention relates to accessing a subsea oil or gas production well. Such access is required for a number of reasons for example, to take further measurements of the reservoir by introducing logging devices, for servicing and installation of electric submersible pumps to enhance production rates and for many other reasons.

BACKGROUND OF THE INVENTION

Typically for a subsea production well the original drilling platform will have been removed and the well head will have to accessed by means of a suitable surface vessel. In order that the required operations can be carried out as the well it is necessary that the movement of the vessel which is floating on the surface of the sea be compensated for to ensure positional consistency with respect to the well itself which is fixed on the sea bed. This is conventionally provided by means of a heave compensation system on the vessel itself which is extremely cumbersome and expensive.

Traditionally the outer tubing for intervention purposes has been approximately 7 inches in diameter when it necessary to carry out operations which require tool strings and other equipment which necessarily have a diameter of approximately 7 inches. This outer tubing is called a riser and is conventionally made of jointed sections. Coiled tubing on the other hand is only available in a maximum diameter of 4.5 inches and it is therefore not possible to use continuous coiled tubing as the riser because it has insufficient diameter to contain the tool string and equipment and therefore carry out well intervention operations which require the use of tool strings and equipment having a diameter greater than 4.5 inches. Typically in the present state of the art continuous coiled tubing will be used as the inner tubing which enters the well itself inside the riser to carry out the various intervention operations that are required.

There are a number of disadvantages to the use of a jointed riser. For example, the surface vessel has to be located and anchored accurately above the well head in a very time consuming operation. It will be appreciated that in well intervention operations a large proportion of the cost arises from the hire charges, or lease charges, or cost of capital whatever the financial arrangement, of the expensive capital equipment, as well as the labor cost off shore. The time spent carrying out the required operations has therefore a critical effect on costs. In addition to the need for accurately anchoring the surface vessel it is also necessary to include heave compensation systems to compensate for the relative movement of the generally fixed riser and the surface vessel which will rise and fall with the swell of the sea.

OBJECTS OF THE INVENTION

It is an object of the invention to provide a method and apparatus ensuring positional consistency between the well head and the vessel without the need for an expensive heave compensation system on the vessel. It is another object to ensure that there is no damage caused to the well head by bending moments applied by movement of the piping connecting it to the surface vessel.

It is another object of the invention to enable well intervention operations to be carried out using lower diameter coiled tubing as the riser instead of jointed tubing.

SUMMARY OF THE INVENTION

According to the invention there is provided a guide arrangement for a riser head arrangement for accessing a subsea well, which is intended to be fixedly connected at one end to a well head, in which the guide arrangement comprises at least one first buoy comprising a chamber which contains a relatively heavy fluid such as water and is capable of being evacuated of the relatively heavy fluid which is replaced by a relatively lighter fluid, such as air, wherein the at least one first buoy is connected to one end of a guide line whose other end is connected to the well head such that when said the chamber is evacuated tension is induced in the guide line and the guide arrangement forms a rigid structure capable of guiding the riser head arrangement to the well.

According to a further aspect of the invention the guide arrangement is arranged together with the riser head arrangement and guide wires extend from the riser head arrangement for connection to the well head.

According to a preferred aspect of the invention of the guide arrangement the guide wires may also connected to an at least one second buoy and the first and second buoys are preferably arranged one below the other and on the same axis.

According to a further aspect of the invention the or each first buoy comprises a guide surface to assist the access of the riser head arrangement.

Also the riser assembly may include a flex or stress joint as a safety precaution to prevent any bending moment in the riser assembly from being transmitted to the well head.

According to a further preferred aspect of the invention the guide arrangement comprises two first buoys arranged diametrically opposite one another and forming the access for the riser head arrangement between them. The two first buoys may be connected together by means of an open frame which forms an access space for the riser head arrangement.

Alternatively the guide arrangement according may comprise four first buoys arranged in diametrically opposite pairs and forming the access for the riser head arrangement between them. The four first buoys may be connected together by means of an open frame which forms an access space for the riser head arrangement. The frame may include guide surfaces to assist the access of the riser head arrangement.

The preferred method of accessing a well head comprises the following steps;

1. Connection of the guide lines of a guide arrangement comprising at least one buoy to the well head.
2. Evacuating at least part of said buoy to allow the guide arrangement to rise and aligning it with the well head and inducing tension in the guide line to provide a rigid support in the aligned position for the connection of the said riser head arrangement to the well head.

An alternative method of accessing a well head with coiled tubing comprises the following steps;

1. Connection of guide lines of a guide arrangement including first and second buoys to the well head.
2. Alignment of the guide arrangement including the first and second buoys with the guide pins of the well head.
3. Filling of the at least one of said second buoy with water to allow it to fall and be connected to the well head, the said at least one first buoy being evacuated and providing a rigid support in the aligned position during the connection of the said riser head arrangement to the well head.

BRIEF DESCRIPTION OF THE DRAWING

The invention is described in greater detail with reference to the accompanying drawing in which.

SPECIFIC DESCRIPTION

Figure 1:
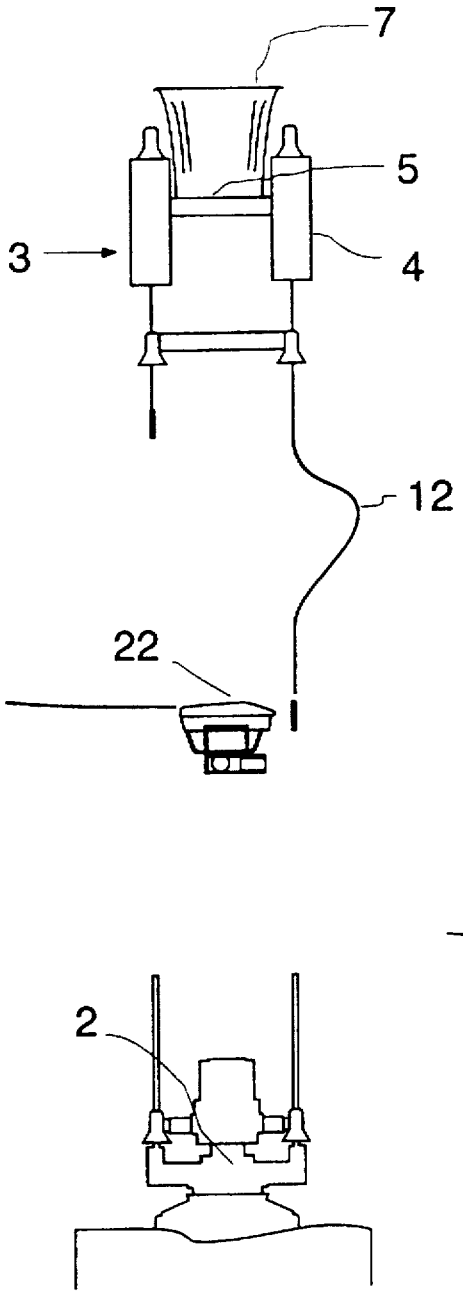
FIG. 1 is a cross sectional view of the guide arrangement according to a first embodiment of the invention.
Figure 2:
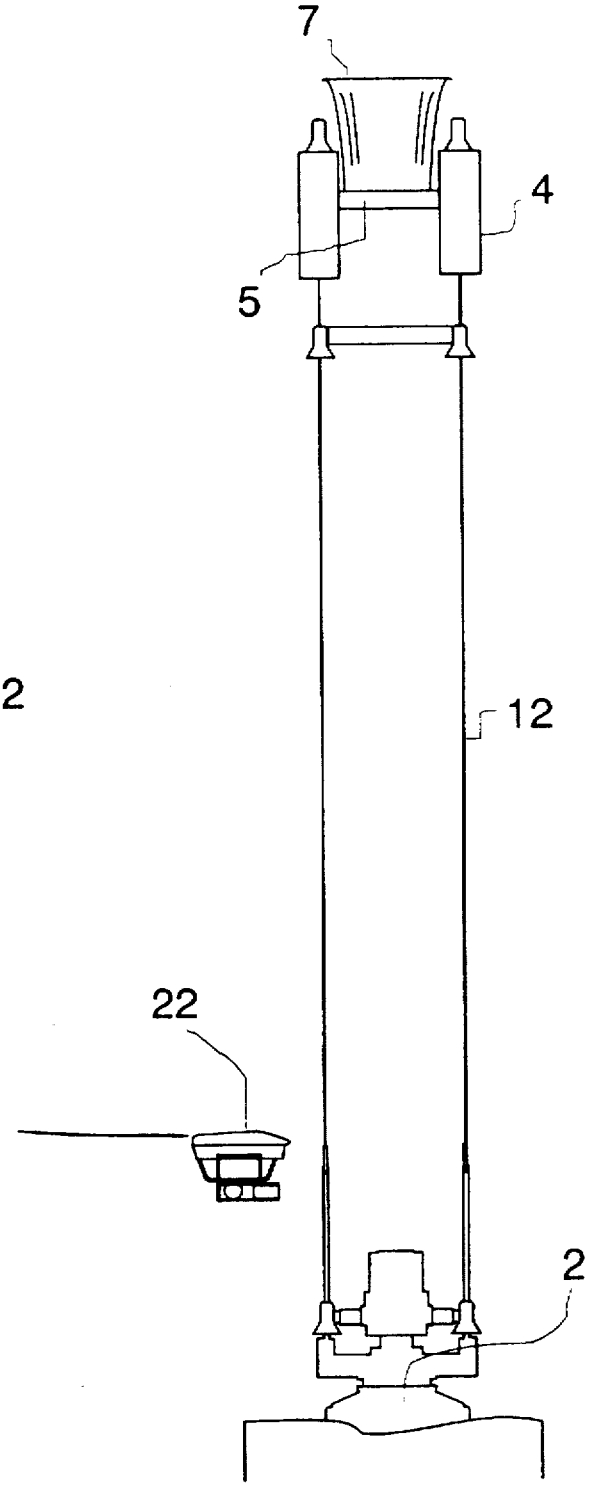
FIG. 2 is side view of the guide arrangement of FIG. 1 in the assembled condition.
Figure 3:
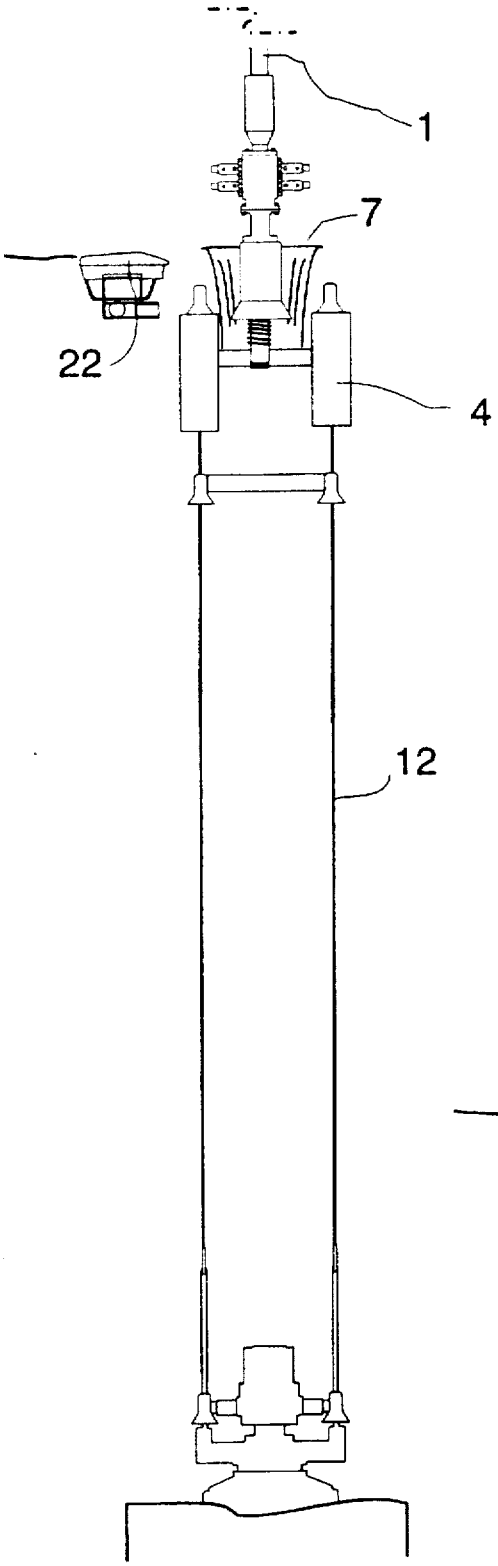
FIG. 3 is a side view of the guide arrangement of FIG. 2 showing the access of the riser head arrangement.
Figure 4:
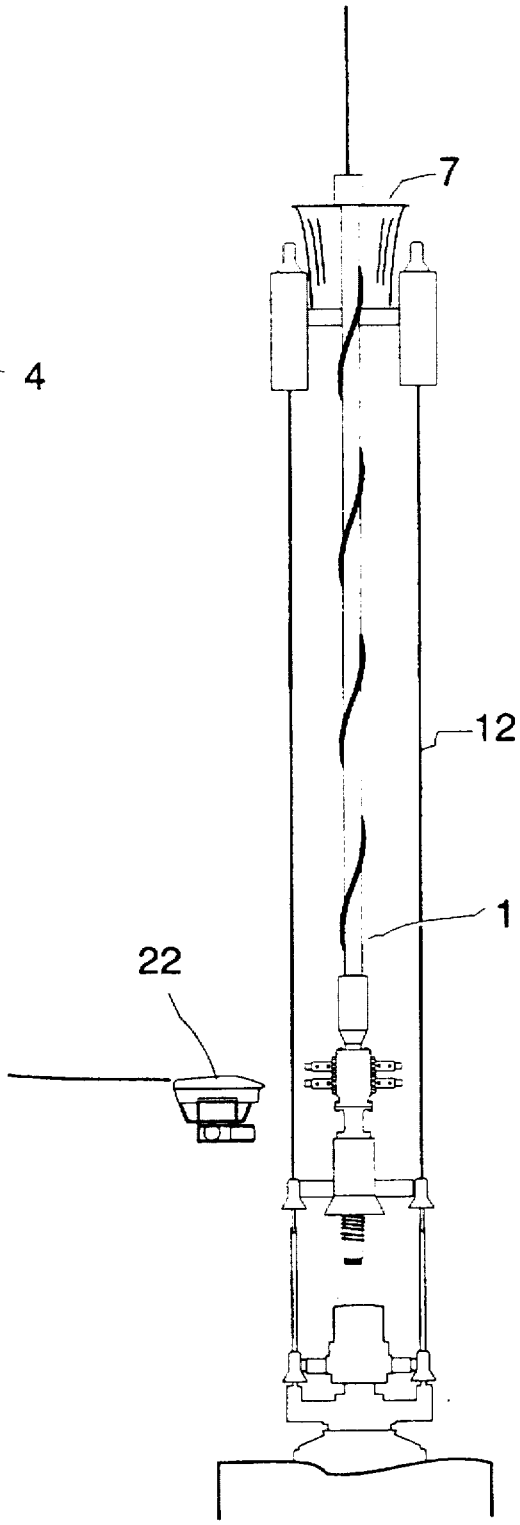
FIG. 4 is a side view of FIG. 3 showing the complete access of the riser head arrangement.

FIG. 1 to FIG. 4 show that the guide arrangement 3 comprises buoys 4, a connecting frame 5 and guide lines 12 extending from the lower end of the buoys 4. The guide arrangement 3 is lowered by means of a wire support from a surface vessel 8 and when it is in position a remote vehicle 22 is used to connect the guide lines 12 to the well head 2. When the guides lines 12 are connected, the buoys 4 can be evacuated, which means that the water contained inside is pumped out and replaced by air as shown in FIG. 2. This causes the buoys to rise and induces significant tension in the guide lines 12 such that a rigid structure is produced which acts as a guide for the access of the riser head assembly 1. From FIG. 3 it can be seen that the riser tube head arrangement 1 is guided to the access provided by the open frame 5 of the buoys 4 with the assistance of guides 7. FIG. 4 shows the riser head assembly in position ready to be attached to the well head for well intervention operations to commence. It can be seen by the person skilled on the art that by this means very simple and expensive access to the well head is provided for a coiled tubing riser.

Figure 5:
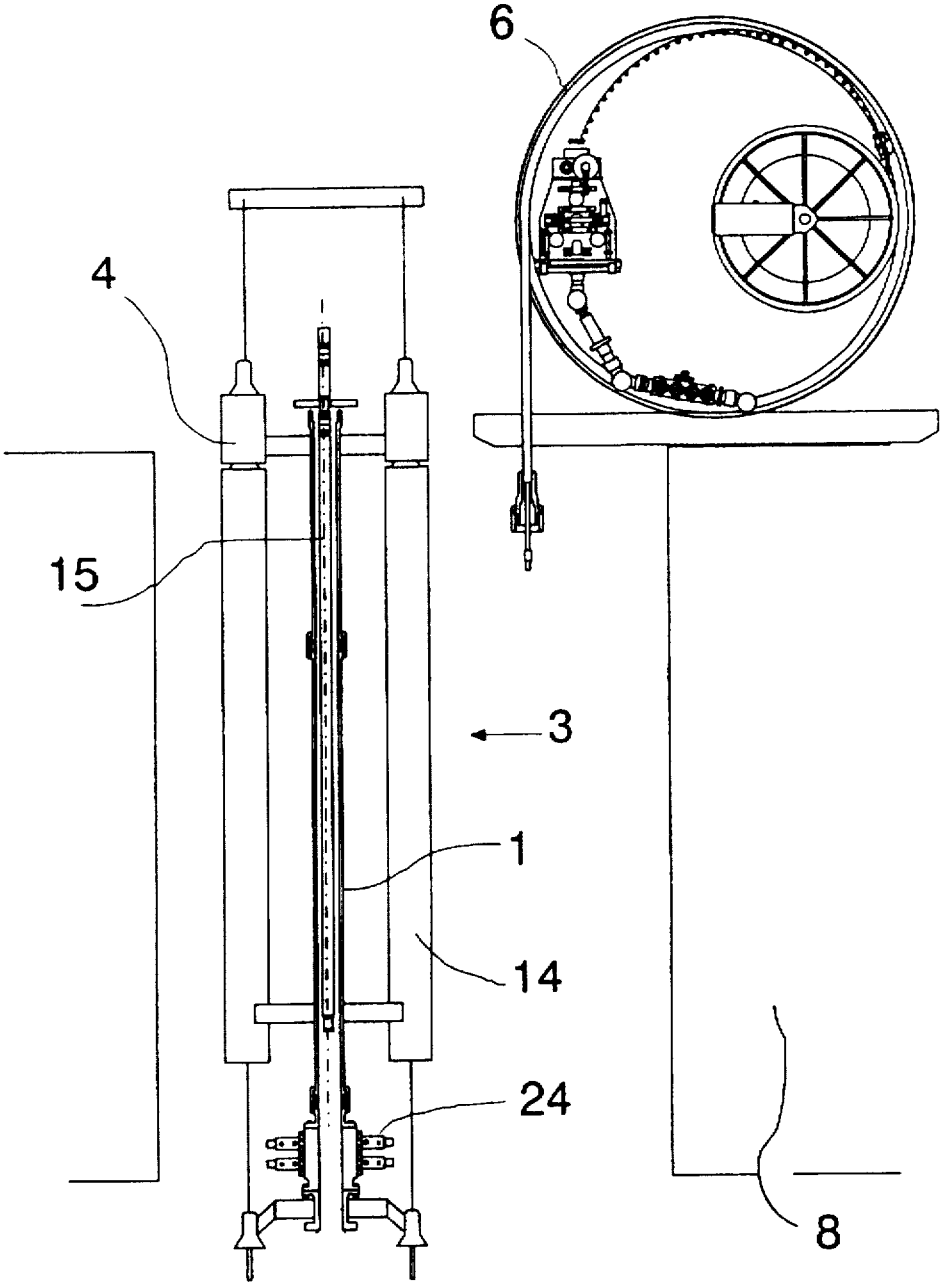
FIG. 5 is a side view of an alternative embodiment of the invention with the guide arrangement including the riser head assembly before deployment.

FIG. 5 shows an alternative embodiment of the invention in which the guide arrangement 15 is lowered to the well head together with the riser head assembly.

Figure 6:
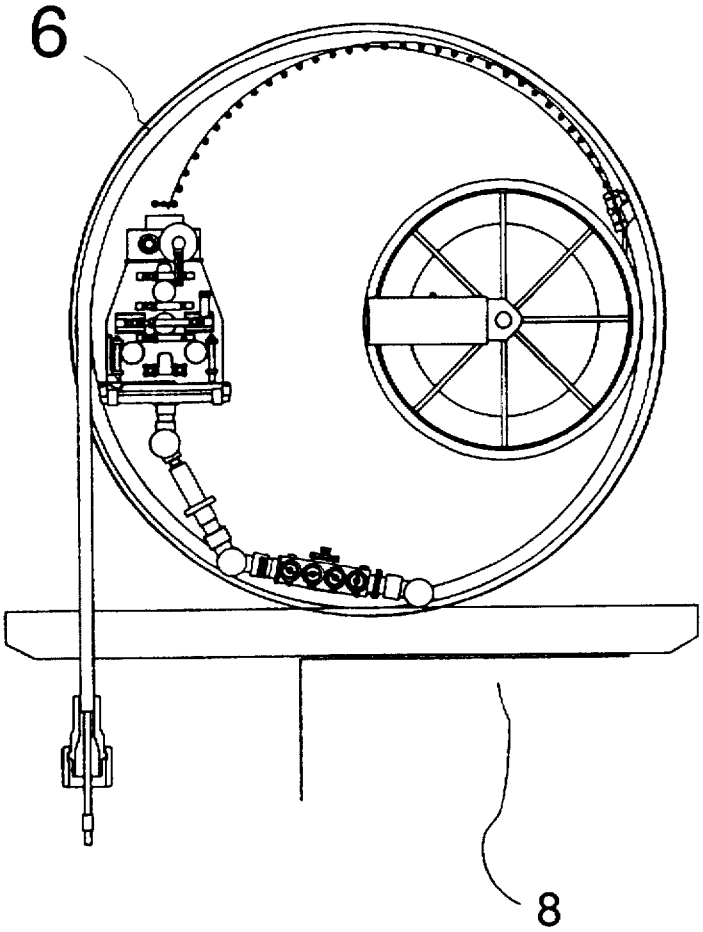
FIG. 6 is longitudinal cross sectional view of the riser assembly of FIG. 5 and the coiled tubing reel in the coiled state as it would be stowed on the vessel.

Referring to FIG. 6, a riser head arrangement 1 is stowed in a surface vessel ready for connection to a continuous coiled tubing 6, and is intended to be fixedly connected to a well head 2. The riser head arrangement 1 comprises two first buoys 4 which are releasably connected to corresponding second buoys 14 (FIG. 5) both of which buoys 4, 14 comprise a chamber which is capable of being evacuated.

Figure 7:
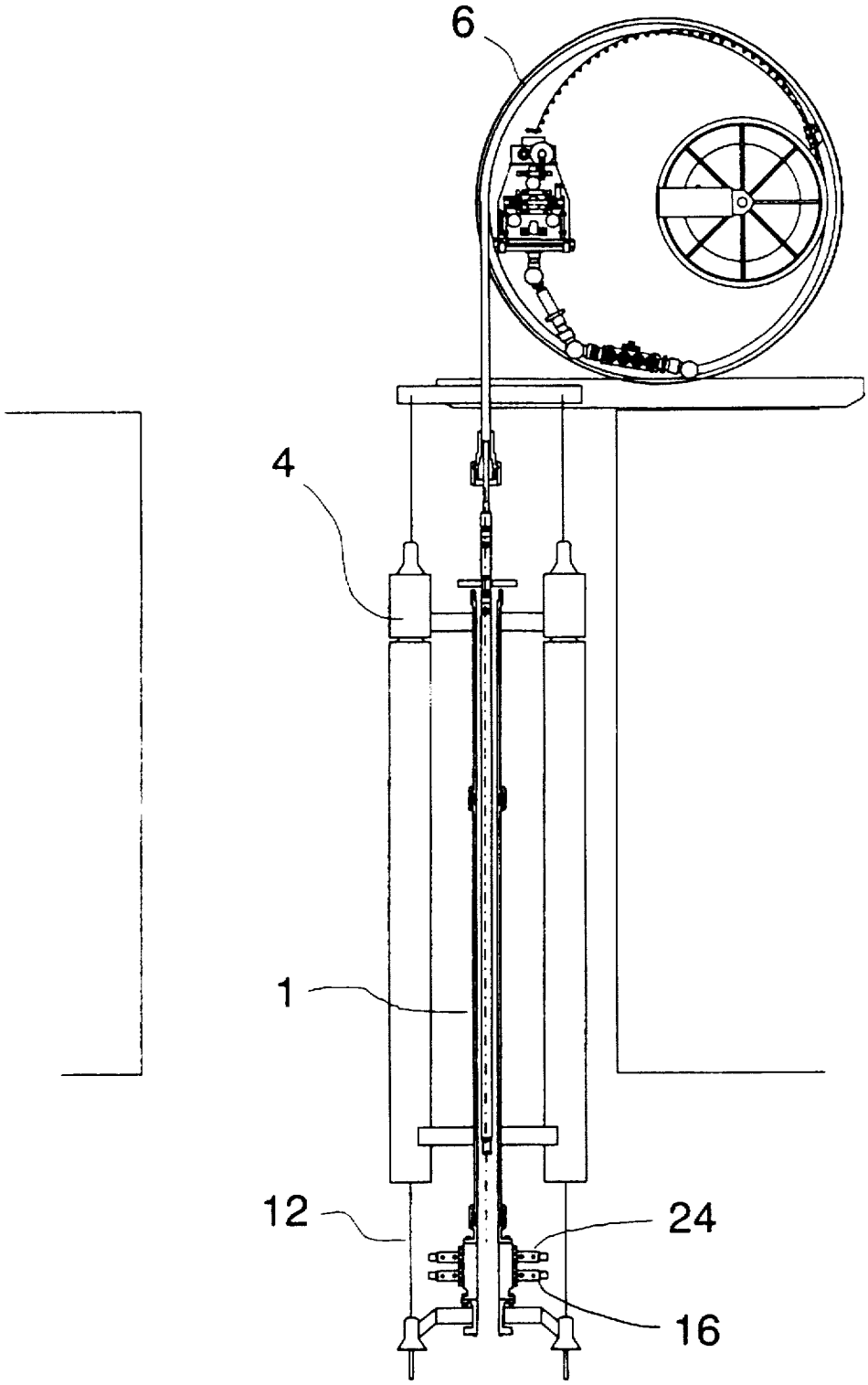
FIG. 7 is a longitudinal cross section of the riser assembly connected to the coiled tubing reel before lowering to the well head.
Figure 12:
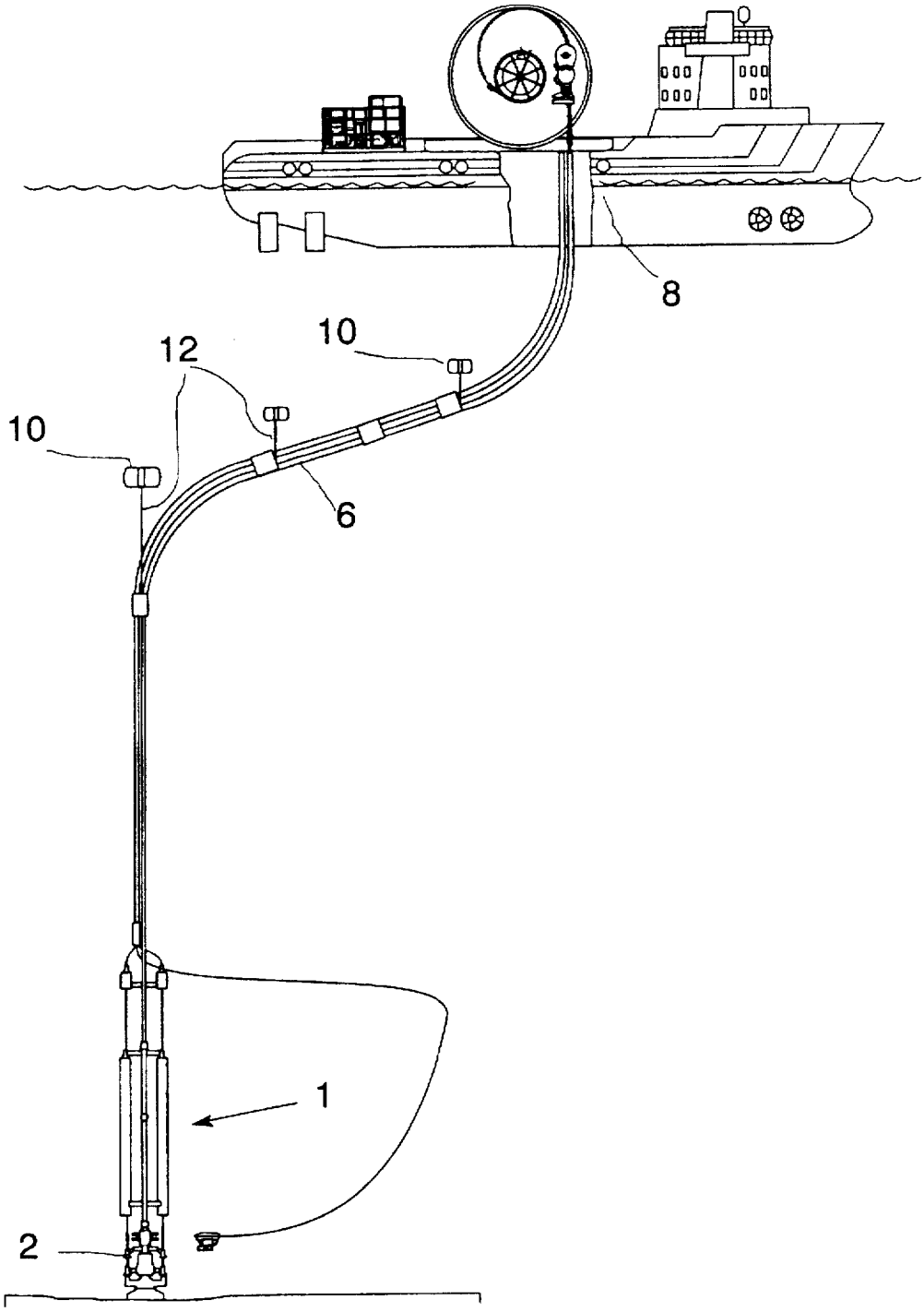
FIG. 12 is a longitudinal cross section of the riser assembly, coiled tubing and surface vessel after connection of the riser assembly to the well head.

In FIG. 7 the riser head arrangement 1 is shown to be provided with a guide arrangement 3*a* including the buoys and is connected to coiled tubing 6 which connects it to a surface vessel 8 (FIG. 12).

Figure 8:
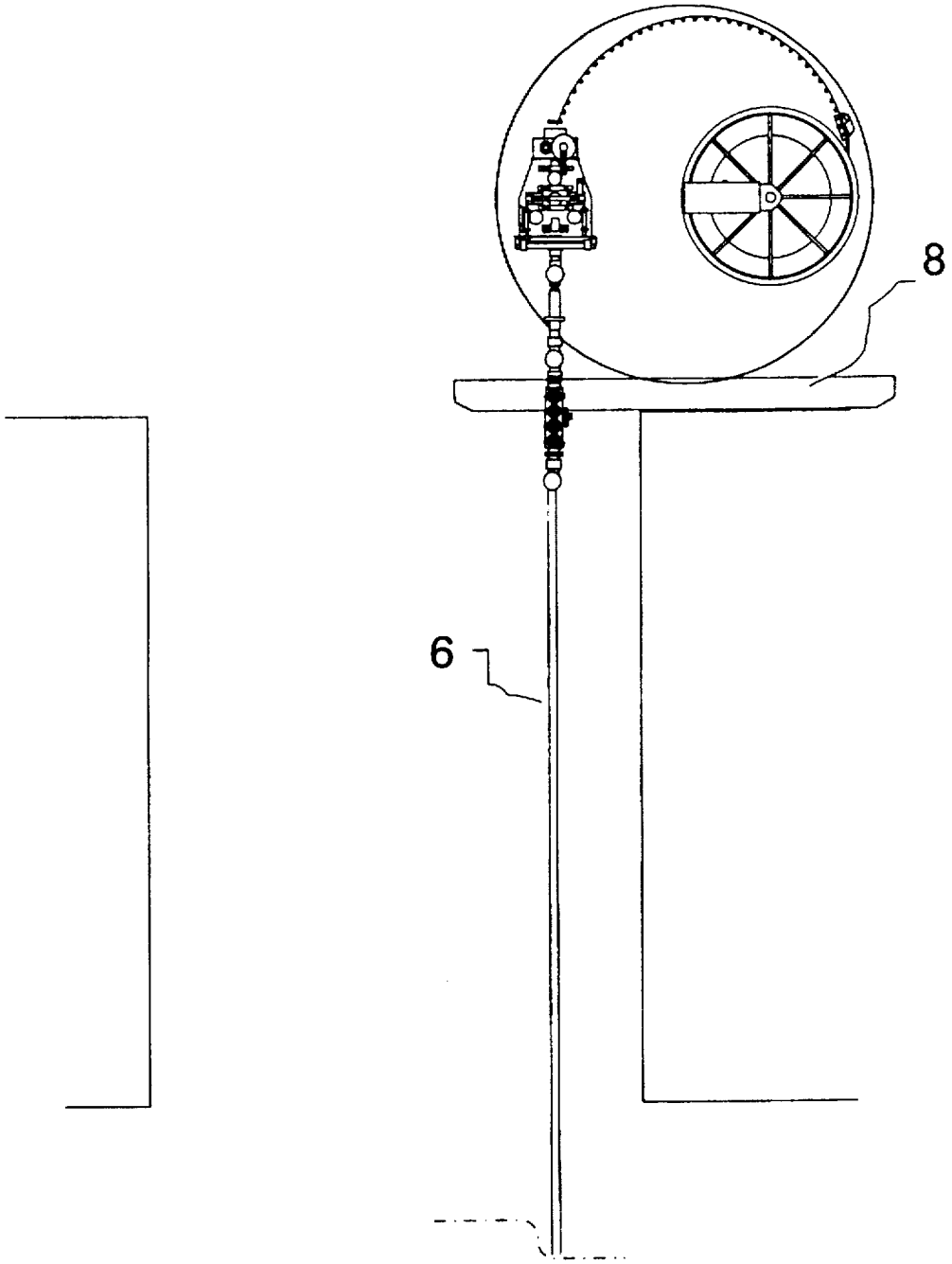
FIG. 8 is a longitudinal cross section of the coiled tubing reel after lowering of the riser assembly to the well head.

Referring to FIG. 8 the riser head arrangement 1 is then lowered on the end of the coiled tubing 6 (representing continuous tubing) to the location of the well head 2.

Referring to FIG. 12 it can be seen that a number of support buoys 10 are provided each of which can comprise a chamber which is capable of being evacuated and refilled. The support buoys 10 are connected to the riser head arrangement 1 and the coiled tubing 6 by means of guide lines 12 at intermittent points along the coiled tubing between the riser head arrangement 1 and the vessel 8. By this means the profile of the coiled tubing 6 can be controlled so that it provides an even incline which will permit the easy flow of the required equipment and instrumentation down to the well head. The coiled tubing 6 is also made sufficiently long and allowed to bend with the movement of the heave of the sea or ocean to avoid the need for a heave compensation system on the vessel itself.

Figure 9:
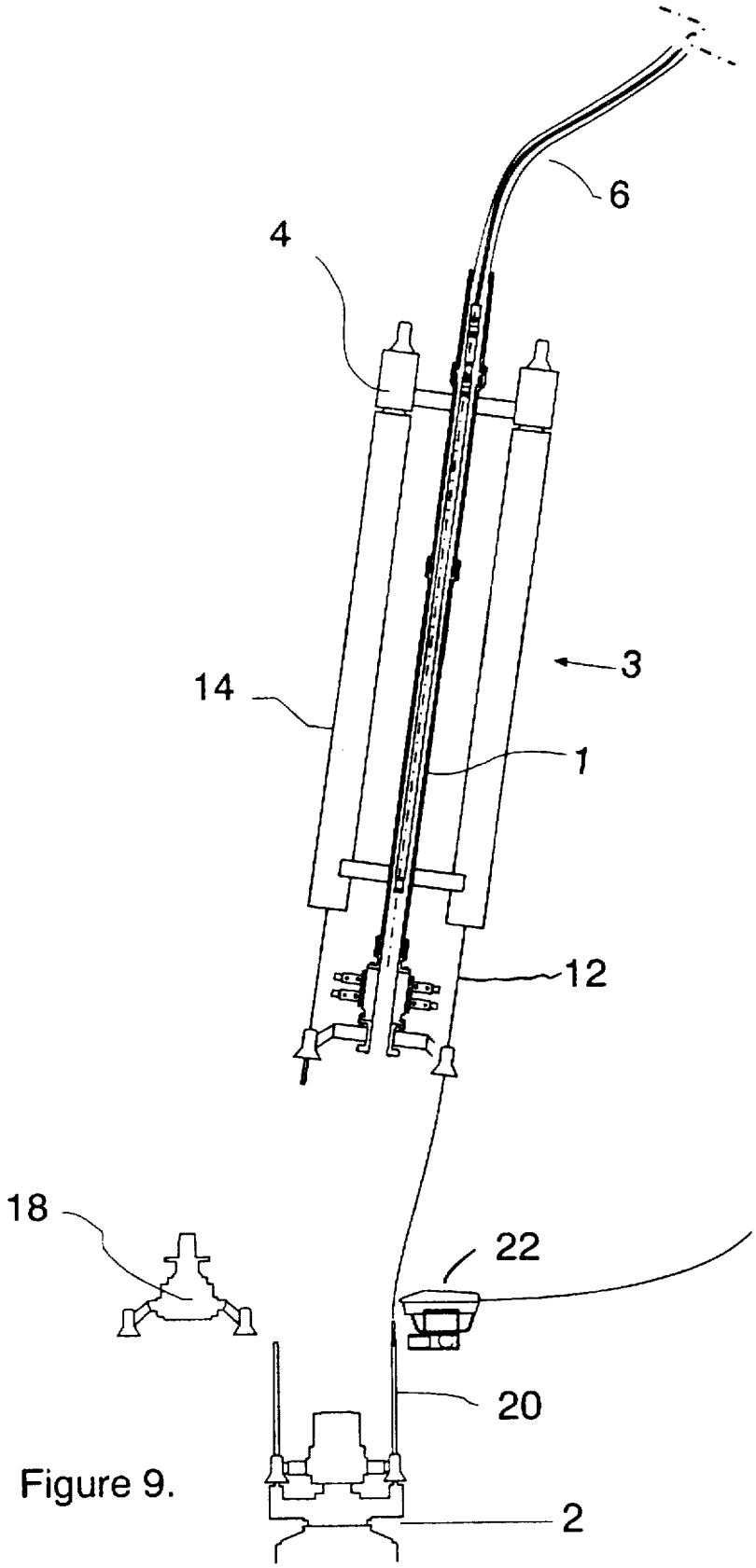
FIG. 9 is a longitudinal cross section of the riser assembly after lowering to the well head.

Referring to FIG. 9 the riser head arrangement 1 is also connected to at least one guide buoy 14 which can also be evacuated and refilled to align the riser head arrangement 1 accurately above the well head 2. The riser head arrangement 1 also includes a blow out preventer 24 (FIG. 7) as a safety precaution as well as a flex or stress joint 16 (FIG. 7) as a safety precaution to prevent any bending moment in the riser assembly being transmitted to the well head 2.

Figure 10:
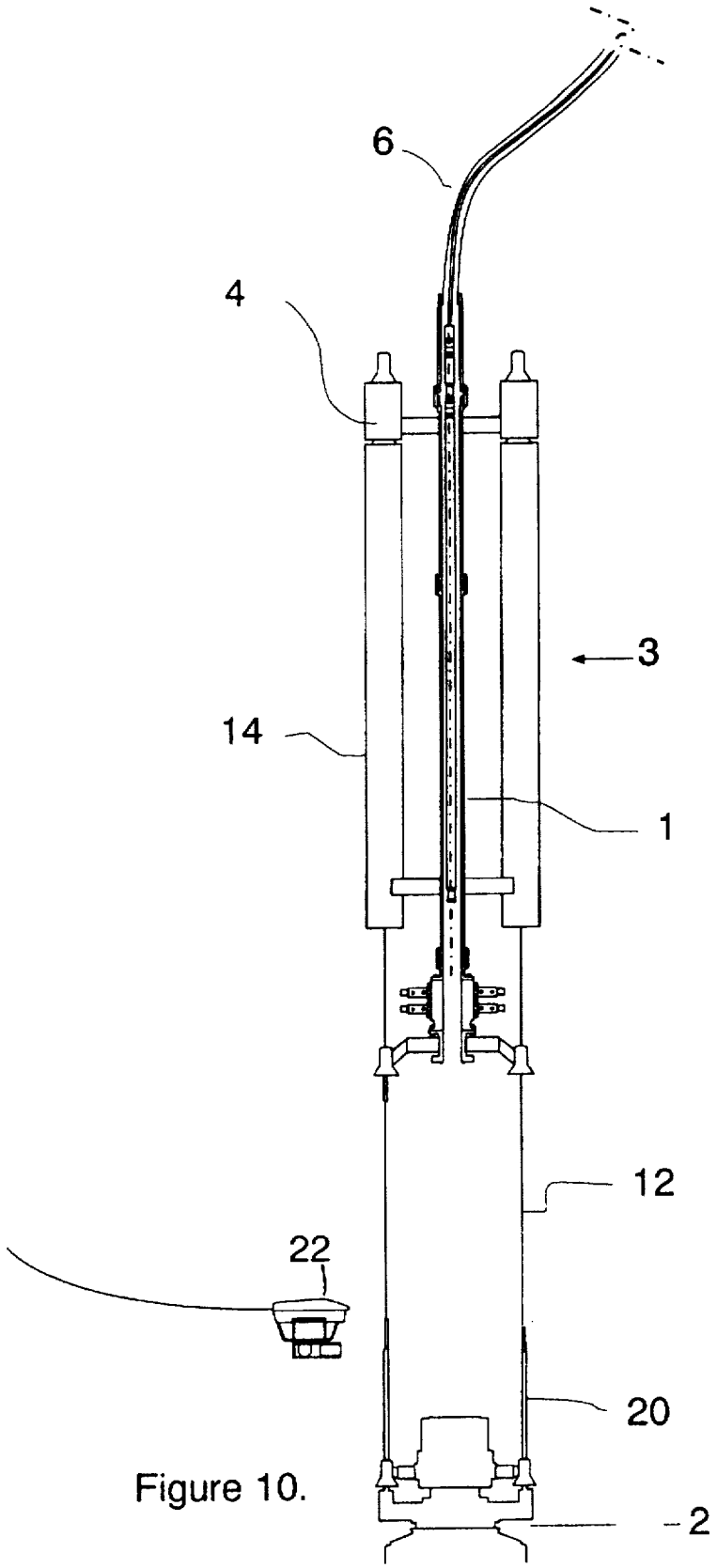
FIG. 10 is a longitudinal cross section of the riser assembly after alignment with the well head.
Figure 11:
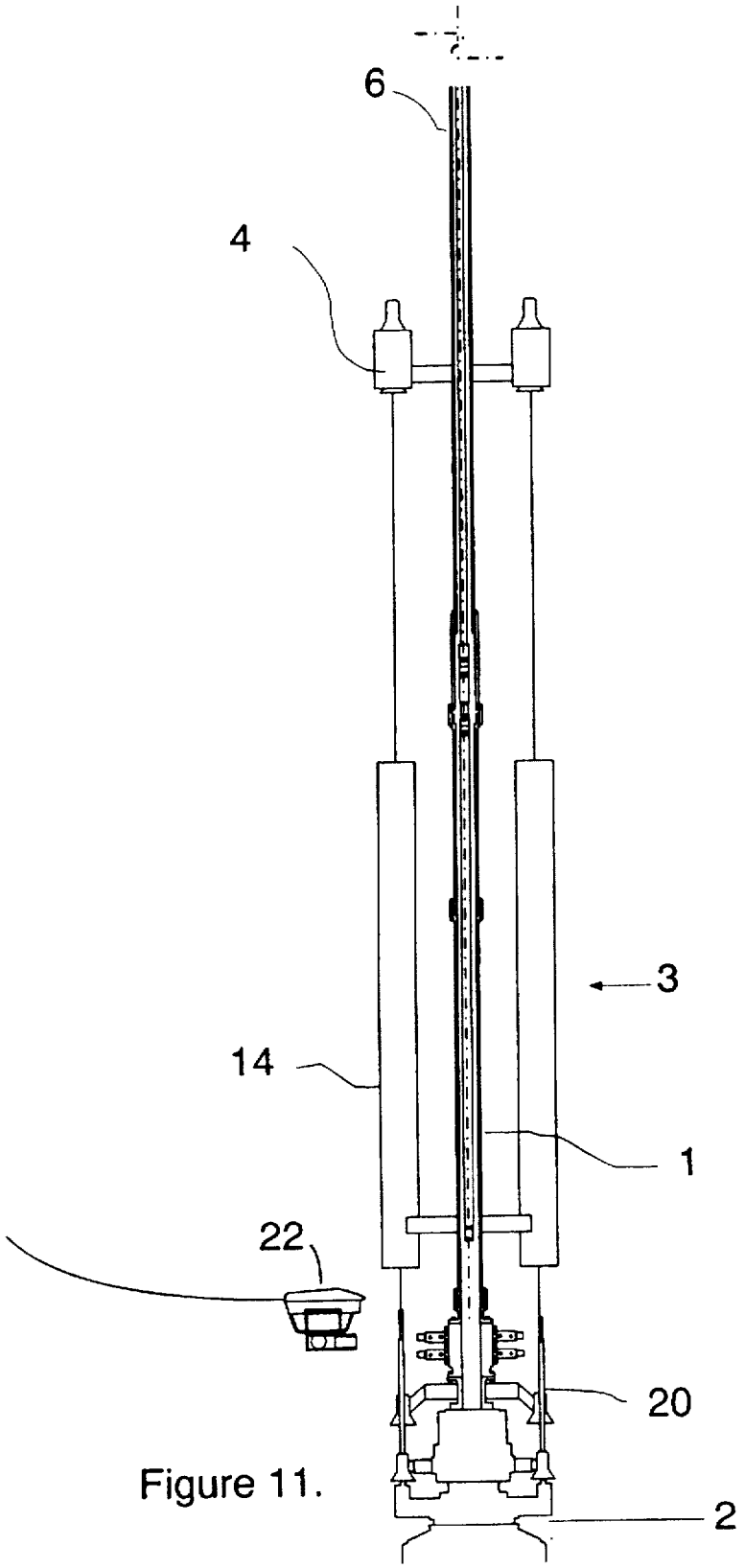
FIG. 11 is a longitudinal cross section of the riser assembly after connection to the well head.

Referring to FIGS. 9 to 11 the riser assembly is attached to the well head 2 by the following method:

1. The tree cap 18 (FIG. 9) on the existing well head 2 is removed to expose the guide pins 20.
2. The guide lines 12 of the riser assembly are connected to the well head guide pins 20 by means of a remote vehicle 22.
3. The riser head arrangement 1 is aligned with the guide pins 20 of the well head 2 by means of evacuation and refilling of first and second guide line buoys 4, 14 or by any other suitable method such as the
4. The second guide line buoys 14 are filled with sea water or other suitable fluid to allow the riser head arrangement 1 to fall and be connected to the well head 2. The first guide line buoys 4 remain evacuated and provide a rigid structure for the connection procedure of the riser head arrangement 1 with the well head 2.
5. Following connection of the riser head arrangement 1 to the well head 2 the riser buoys 4 are maintained evacuated to provide a rigid structure which will prevent any bending moment being applied to the well head 2.

The buoyancy effect of the evacuated riser buoys 4 has the effect of providing a tensile stress throughout the well head and guide arrangement 3 which provides it with a resilience to bending forces. It is these bending forces which are the main danger because they cause the flanged seals in the whole system to leak. It is estimated that each cubic meter of evacuated volume within the riser buoys 4 will provide a vertical upward force on the well head riser assembly of one ton.

Finally referring to FIG. 12 the support buoys 10 are adjusted by means of evacuation and/or refilling to ensure the desired profile of the coiled tubing 6.

The above embodiment describes the invention as applied to coiled tubing by way of example only and it will be appreciated by the person skilled in the art that the invention could just as easily be applied to a jointed tube system.

What is claimed is:

1. A system for accessing a subsea well, comprising:

a surface vessel above a well head of a subsea well;

a flexible coiled tubing paid out from said vessel and of a length sufficient to compensate for movement of said vessel relative to said well head;

adjustable buoyancy members along said tubing between said vessel and said well head for controlling a profile of at least a stretch of said tubing between said vessel and said well head; and a guide arrangement connected to said well head and comprising:

evacuatable members including at least one buoy having a chamber receiving a liquid evacuatable from said chamber so as to raise said at least one buoy from said well head, a guide line having an end connected to said at least one buoy and another end tethered to said well head, said guide line being tensioned upon evacuation of said liquid from said chamber, a guide on said at least one buoy alignable with said well head upon tensioning of said guide line for guiding said coiled tubing into said well head, said guide arrangement forming a rigid structure upon evacuation of said liquid from said chamber for guiding said flexible coiled tubing, said at least one buoy being located at an upper part of said guide arrangement.

2. The system defined in claim 1, further comprising a riser head guided on said guide line and movable toward said well head therealong, said riser head being formed with said guide.

3. The system defined in claim 2 wherein said evacuatable members includes another buoy slidable along said guide line and carrying said guide.

4. The system defined in claim 3 wherein said buoys are located along a common axis.

5. The system defined in claim 2, further comprising means forming a flex joint at said riser head to limit strain upon said well head.

6. The system defined in claim 2 wherein two first buoys are provided diametrically opposite one another and two other buoys are provided diametrically opposite one another, said first buoys being interconnected by an open frame.

7. The system defined in claim 6 wherein said other buoys are interconnected by an open frame carrying said guide.

8. The system defined in claim 1 wherein two buoys are provided diametrically opposite one another and are interconnected by an open frame.

9. The system defined in claim 1 wherein two pairs of buoys are provided diametrically opposite one another and 90° from one another and said buoys are interconnected by an open frame.

10. The system defined in claim 1 wherein two diametrically opposite guide lines run from said buoyancy members to said well head.

11. A method for accessing a subsea well comprising the steps of:

(a) positioning a surface vessel above a well head of a subsea well;

(b) tethering at least one buoy of a guide arrangement to said well head with a guide line, said guide arrangement having a guide alignable with said well head;

(c) evacuating said at least one buoy to tension said line, render said guide arrangement rigid and align said guide with said well head;

(c) feeding a flexible coil tubing from said vessel through said guide to said well head;

(e) extending said tubing between said vessel and said guide for a length sufficient to compensate for movement of said vessel relative to said well head; and (f) controlling a profile of at least a stretch of said tubing between said vessel and said well head by affixing to said stretch adjustable buoyancy members and controlling the buoyancy of said members.

* * * * *